US012029953B2

(12) United States Patent
Gainford

(10) Patent No.: US 12,029,953 B2
(45) Date of Patent: Jul. 9, 2024

(54) SPORTS APPARATUS FOR PRACTICING FOOTBALL KICKING SKILLS

(71) Applicant: Paul Gainford, Bromley (GB)

(72) Inventor: Paul Gainford, Bromley (GB)

(73) Assignee: Paul Gainford, Bromley (GB)

( * ) Notice: Subject to any disclaimer, the term of this patent is extended or adjusted under 35 U.S.C. 154(b) by 0 days.

(21) Appl. No.: 17/057,707

(22) PCT Filed: May 23, 2019

(86) PCT No.: PCT/GB2019/051426
§ 371 (c)(1),
(2) Date: Nov. 23, 2020

(87) PCT Pub. No.: WO2019/224547
PCT Pub. Date: Nov. 28, 2019

(65) Prior Publication Data

US 2021/0197054 A1 Jul. 1, 2021

(30) Foreign Application Priority Data

May 23, 2018 (GB) ..... 1808497

(51) Int. Cl.
*A63B 69/00* (2006.01)
*A63B 69/40* (2006.01)

(52) U.S. Cl.
CPC ..... *A63B 69/0075* (2013.01); *A63B 69/002* (2013.01); *A63B 69/40* (2013.01)

(58) Field of Classification Search
CPC .... A63B 69/002; A63B 69/0075; A63B 69/40
USPC ..... 473/420, 422
See application file for complete search history.

(56) References Cited

U.S. PATENT DOCUMENTS 4,523,573 A 6/1985 Defosse et al.
4,655,453 A * 4/1987 Spiegel ..... A63B 69/0075 473/420
4,775,151 A * 10/1988 Berry ..... A63B 71/06 473/420
6,296,582 B1 * 10/2001 Minniear ..... A63B 69/0091 473/428
7,175,536 B1 * 2/2007 Tortola ..... A63F 13/245 473/146

(Continued)

FOREIGN PATENT DOCUMENTS

GB 2487075 7/2012
GB 2518362 3/2015

(Continued)

OTHER PUBLICATIONS

International Search Report and the Written Opinion dated Sep. 23, 2019 From the International Searching Authority Re. Application No. PCT/GB2019/051426. (9 Pages).

(Continued)

*Primary Examiner* — Mitra Aryanpour

(57) ABSTRACT

The present invention relates to a sports apparatus (100). The sports apparatus (100) comprises: a ball holder (102); and a motor (110) arranged to rotate said ball holder (102); wherein an axis of rotation of a drive of the motor (110) is offset from the axis of rotation of the ball holder (102). The sports apparatus (100) is used for practicing football kicking skills.

18 Claims, 6 Drawing Sheets

(56) References Cited

U.S. PATENT DOCUMENTS

| | | | | |
|---|---|---|---|---|
| 7,214,136 | B1 * | 5/2007 | Perry | A63B 69/3655 473/145 |
| 8,777,781 | B2 * | 7/2014 | Marks | A63B 69/002 473/429 |
| 9,782,661 | B2 * | 10/2017 | Griffin | A63B 71/0605 |
| 2004/0020481 | A1 | 2/2004 | Keller et al. | |
| 2008/0110066 | A1 | 5/2008 | Peroni | |
| 2015/0360107 | A1 * | 12/2015 | Achkar | A63B 69/0079 473/429 |
| 2017/0333773 | A1 * | 11/2017 | Hamilton | A63B 71/0686 |
| 2021/0197054 | A1 * | 7/2021 | Gainford | A63B 69/40 |

FOREIGN PATENT DOCUMENTS

| | | |
|---|---|---|
| SU | USSR 1326302 | 7/1987 |
| WO | WO 2019/224547 | 1/2019 |

OTHER PUBLICATIONS

Patents Act 1977: Search Report under Section 17(5) dated Oct. 7, 2019 From the Intellectual Property Office of the United Kingdom of Great Britain Re. Application No. 1808497.0 (3 Pages).

* cited by examiner

SPORTS APPARATUS FOR PRACTICING FOOTBALL KICKING SKILLS

RELATED APPLICATIONS

This application is a National Phase of PCT Patent Application No. PCT/GB2019/051426 having International filing date of May 23, 2019, which claims the benefit of priority of United Kingdom Patent Application No. 1808497.0 filed on May 23, 2018. The contents of the above applications are all incorporated by reference as if fully set forth herein in their entirety.

FIELD AND BACKGROUND OF THE INVENTION

The present invention relates to a sports apparatus and in particular, but not exclusively, to a sports apparatus for practicing football kicking skills.

The game of association football (soccer), referred to herein as football, is played in many countries throughout the world and at many different standards. There are a number of kicking skills associated with football that range from the basics of passing and shooting a football to advanced skills such as curling a ball (also commonly referred to as bending or swerving a football). Curling a ball may be considered to be one of the most exciting kicking skills in football and is commonly used in set plays, where a highly skilled player curls a ball around and/or over a defensive wall to take a shot at goal. This skill may also be used when taking corner kicks, crossing a ball into the penalty box, passing the ball around an opponent or shooting at goal.

To curl a football the ball should be kicked off-centre with the inside or outside of the foot depending on which direction the ball is to be curled, and struck in such a way so as to cause the ball to rotate as it travels through the air. The rotation of the ball creates pressure differences around the ball due to drag which in turn causes the ball to experience a force perpendicular to the direction of travel of the ball. The drag on the side of the ball which is turning in the direction of travel of the ball causes the airflow to slow, whereas on the other side of the ball the airflow is sped us. Greater air pressure on the side of the ball where the airflow is slowed down, and lower pressure on the side where the airflow is sped up, forces the ball in the direction of the lower pressure side. This phenomenon is known as the Magnus effect.

The skill of curling a ball requires a great deal of practice and may be frustrating when first practising this skill, with possibly many hours spent without successfully curling the ball.

UK patent application no. GB 2 518 362 discloses a sports apparatus comprising a ball holder; and a motor arranged to rotate said ball holder, wherein said sports apparatus is arranged to contact a given supporting surface to position the ball holder for a user to strike a ball being held and rotated by the ball holder, the contents of which are incorporated by reference herein.

It is an object of the present invention to provide an improved apparatus for teaching the skill of curling a ball.

SUMMARY OF THE INVENTION

Aspects and embodiments of the present invention are set out in the appended claims. These and other aspects and embodiments of the invention are also described herein.

According to an aspect of the invention, there is provided a sports apparatus comprising: a ball holder; and a motor arranged to rotate said ball holder; wherein an axis of rotation of a drive of the motor is offset from the axis of rotation of the ball holder.

Preferably, the motor is laterally offset with respect to the ball holder.

Preferably, the motor and the ball holder are arranged in substantially the same plane, preferably wherein that plane is substantially parallel to a given supporting surface on which the apparatus is mounted.

Preferably, the sports apparatus further comprises a control system for controlling the rotation of the ball holder.

Preferably, the control system comprises a printed circuit board and a control panel.

Preferably, the control system controls the rotation of the ball holder by regulating power supplied to the motor.

Preferably, the control system is arranged in substantially the same plane as the ball holder.

Preferably, the control system is arranged in substantially the same plane as the ball holder. Preferably that plane is substantially parallel to a given supporting surface on which the apparatus is mounted.

Preferably, the sports apparatus further comprises a power supply for powering the motor.

Preferably, the power supply is in the form of a battery pack.

Preferably, the power supply is arranged in substantially the same plane as the ball holder, preferably wherein that plane is substantially parallel to a given supporting surface on which the apparatus is mounted.

Preferably, the motor is arranged to drive rotation of the ball holder via a coupling. Preferably, the coupling is in the form of a gearing arrangement.

In one example, there is provided a sports apparatus comprising: a ball holder; and a motor arranged to rotate said ball holder; wherein said sports apparatus is arranged to contact a given supporting surface to position the ball holder for a user to strike a ball being held and rotated by the ball holder; and wherein the motor is disposed adjacent said ball holder so as to drive rotation of the ball holder from a side engagement of the ball holder.

The sports apparatus is arranged to assist or train a user to curl a ball. The sports apparatus is arranged to minimise the height of the ball, which is being struck by the user, above the supporting surface. Minimising the height of the ball above the supporting surface makes for a more realistic training experience for the user, as any ball curling skills developed using the sports apparatus will be more easily transferred to the situation where the ball is struck directly from the ground.

It is envisaged that the sports apparatus may be used as a toy, for example by children in a park who wish to have fun curling a ball. It may also be used as a training aid for training goalkeepers to defend a goal against curled shots, as the person kicking a ball at a goal that the goalkeeper is defending does not have to be proficient at curling a ball. It may also be used by footballer players of all levels to understand and develop the technique required to curl a ball.

The ball holder of the sports apparatus may comprise an annular ring, having an annular ring gear, and the motor may comprise a pinion gear arranged to engage with the annular ring gear whereby to rotate the ball holder.

The annular ring gear may be arranged on an underside of the annular ring of the ball holder. This is so that the ball holder can be rotated by a motor disposed adjacent the ball holder which provides the advantage of keeping the ball holder, and therefore the ball it is holding, as close to the supporting surface as possible in order to provide a more realistic training experience for the user.

The ball holder may be arranged to rotate on an annular bearing. Additionally, the ball holder may comprise a skirt extending or depending from its underside.

The annular bearing may comprise an annular groove arranged to receive the skirt of the ball holder such that the skirt of the ball holder can rotate within the annular groove of the annular bearing. Alternatively, the ball holder may be arranged to rotate on a different type of bearing. For example, the bearing could be a type of ball bearing which provides for the ball holder to rotate freely.

The sports apparatus may comprise a housing and a base, wherein the housing and base are arranged to retain the ball holder and the bearing.

The annular bearing may be secured between upper and lower portions of a clamping arrangement, preferably whereby to secure the bearing to the base of the apparatus.

The base may have a cut-out portion arranged to receive the motor. Such a cut-out portion provides the advantage of minimising the height of a ball, being held by the apparatus, above the supporting surface. Minimising the height of a ball, being held by the apparatus, above the supporting surface makes for a more realistic training experience for the user, as any ball curling skills developed using the sports apparatus will be more easily transferred to the situation where the ball is struck directly from the ground.

The housing may have an opening revealing or exposing the ball holder, such that a ball can be held on the ball holder through said opening. This opening, along with the annular shape of the ball holder, the annular ring gear and the bearing, provides an advantage by reducing the overall height of a ball, being held by the apparatus, above the supporting surface. This is because the components which provide rotation to the ball holder, including the bearing and the annular ring gear, do not need to be disposed below the lowest point of the ball being held, because part of the ball is allowed to protrude through this opening in the housing and through the centres of the ball holder and bearing annuli. The opening in the housing also provides for a more stable and secure grip on the ball, to counter any wobbling motion of the ball induced by its rotation.

The ball holder and the housing may have chamfered portions arranged such that the housing acts as a guard to retain the ball holder within the apparatus. The annular ring gear, provided on the underside of the annular ring of the ball holder, may have a larger diameter than the annular ring, forming a chamfered rim around the ball holder. A part of the housing may also be chamfered so that, when the housing is attached to the base, the inner surface of the chamfered part of the housing may act against the chamfered lip of the ball holder and therefore provide a guard to retain the ball holder within the apparatus.

The total height of the apparatus (above the supporting surface) is preferably less than 50 millimetres and more preferably less than 25 millimetres.

Preferably, the clearance between a ball, being held and rotated by the ball holder of the sports apparatus, and a given supporting surface on which the ball holder or sports apparatus is mounted is less than 10 millimetres, preferably less than 5 millimetres and more preferably less than 1 millimetre.

Reducing the height of the ball above the supporting surface provides the advantage of a more realistic training experience for the user.

The sports apparatus may be advantageously arranged such that the clearance between a ball, being held and rotated by the ball holder of the apparatus, and the given supporting surface may be less than 10 millimetres, preferably less than 5 millimetres and more preferably less than 1 millimetre. Again, this provides the advantage of reducing the height of a ball, being held by the apparatus, above the supporting surface, making for a more realistic training experience for the user.

The sports apparatus may comprise a damping mechanism to dampen or inhibit wobbling of a ball being held and rotated by the ball holder. Taking the example of a football, footballs from different manufacturers exhibit a natural variation in their sphericity. Furthermore, even different batches of the same model of football from the same manufacturer exhibit variation in their sphericity. That is to say, selecting from any sample of manufactured footballs, few if any will exhibit perfect sphericity. Furthermore, even those footballs that leave the manufacturers in perfect order will not remain that way after typical usage patterns whereby users will kick their balls into an even greater variety of sphericity.

The effect of this variation in sphericity is that each ball has a unique physical reaction to being rotated by the apparatus. The variation in ball sphericity and the resulting variation in the mass distribution of balls, would, on an otherwise perfectly balanced platform, lead to some less perfectly spherical balls becoming unstable when rotated by the apparatus. The balls would either rotate with a wobble which would be discernible to the user, and which may cause inaccuracies when a user attempts to strike the ball, or the ball would fall off the apparatus entirely. Accordingly, the sports apparatus may advantageously comprise a damping mechanism to dampen or inhibit such wobbling.

The damping mechanism may comprise one or more springs arranged to dampen the wobbling of the ball holder during rotation. Alternatively or additionally, the ball holder may comprise a cushioning material on its upper surface, upon which the ball is held, which would adequately dampen the wobbling and/or vibrational motion of the ball. The cushioning material is preferably a substantially elastic material. Alternatively, the ball holder may be retained within the apparatus via springs which provide damping. Advantageously, this will accommodate for all variations of non-sphericity and would not need to be adjusted for different balls. Such a damping mechanism will inhibit wobble when a ball is rotated at any speed but it would be especially advantageous at high speeds.

Preferably, the damping mechanism comprises one or more springs arranged to dampen the lateral component of ball wobble during rotation. Preferably, the damping mechanism comprises one or more springs arranged to dampen the vertical component of ball wobble during rotation.

Preferably, the one or more springs are at least one of: helical coil compression springs; helical coil extension springs; leaf springs; conical springs; torsion springs; spring tabs; or constant force springs.

The sports apparatus may comprise one or more sensors, where said one or more sensors are arranged to identify one or more characteristics of the motion of the ball which has been struck from the apparatus by a user. Preferably, the one or more sensors are at least one of: pressure sensors; force sensors; optical sensors; acoustic sensors; or motion sensors. In this way, a person using the sports apparatus, either to develop ball curling skills or otherwise, will be fed back information relating to the one or more characteristics of the ball's trajectory once it has been struck from the apparatus.

These characteristics might be, for example, the ball's speed upon leaving the apparatus, the direction of the ball's motion upon leaving the apparatus, the ball's time of flight, the distance travelled by the ball, the ball's height as a function of flight time or distance, the direction of the ball's motion as a function of flight time or distance or a measure of the amount of curling imparted to the ball by the user (e.g. using the angle between the initial direction and the final direction of ball's motion during flight).

Advantageously, a user, who is fed back information relating to the one or more characteristics of the motion of the ball which he has struck, will be able to adjust his technique in response to the one or more characteristics in order to develop ball curling skills. For example, if the sports apparatus is used to train a person to curl a football when taking free kicks, the user will want to know the ball's height as a function of flight time or distance once it has been struck so that the user can understand whether or not the ball will clear a wall of defenders of a given height stood at a given distance away from the apparatus. The user will also want to know the initial and final directions of the ball's motion during flight, as the user may want to develop a curling technique whereby the ball will be initially directed to miss the goal but, due to the rotation of the ball, will change direction during flight so that ball is directed finally towards to goal.

Furthermore, if enough characteristics of the ball's motion are identified by the said one or more sensors at one time in the ball's flight, it will be possible to project characteristics of the ball's motion at any later time in the ball's flight. In this way the sports apparatus could be used even when the ball's flight is interrupted by an obstacle either accidently or on purpose. The ball's trajectory could be projected beyond the interrupting obstacle using the characteristics of the ball's motion, as identified by the one or more sensors, up until the point where its motion is interrupted. An example where such trajectory projection would be particularly advantageous would be in the case of an arcade game, where the sports apparatus could be positioned for a user to strike the ball towards an image of, say, a football goal, which is being displayed on a screen. The ball would be struck from the apparatus and its motion would be interrupted by the screen. The trajectory of the ball, having been projected using the characteristics of motion of the ball before interruption, can then be displayed on the screen so that the user is able to see whether the ball would have scored a goal or not. Whilst this example is an arcade game, such an arrangement could be used as a training tool when a playing field and/or football goal is not available.

The one or more sensors may be directly attached to, or attached within, the sports apparatus. For example, there could be one or more pressure sensors attached to the rim of the opening in the housing of the apparatus which could detect the direction of the ball's motion upon being struck from the apparatus or could detect the moment in time at which the ball leaves to apparatus in order to determine the time of flight.

The one or more sensors may be located remotely from the sports apparatus. For example, there could be one or more electromagnetic wave imaging sensors, such as infrared imaging sensors, and/or there could be one or more acoustic sensors, located remotely from the apparatus, for example at one or more locations around a football pitch when the apparatus is used on a football pitch. Such sensors could be used, for example, to detect the position, height, speed and direction of a ball during its flight. Such sensors located remotely from the apparatus could be connected to each other and/or to the apparatus by means of wired or wireless connections and control methods.

Any feature in one aspect of the invention may be applied to other aspects of the invention, in any appropriate combination. It should also be appreciated that particular combinations of the various features described and defined in any aspects of the invention can be implemented and/or supplied and/or used independently.

Any apparatus feature as described herein may also be provided as a method feature, and vice versa. As used herein, means plus function features may be expressed alternatively in terms of their corresponding structure.

Method aspects of the invention may be applied to apparatus aspects, and vice versa. Furthermore, any, some and/or all features in one aspect can be applied to any, some and/or all features in any other aspect, in any appropriate combination.

The invention extends to methods, system and apparatus substantially as herein described and/or as illustrated with reference to the accompanying figures.

The invention will now be described, by way of example only, with reference to the accompanying drawings.

DESCRIPTION OF SPECIFIC EMBODIMENTS OF THE INVENTION

Figure 1:
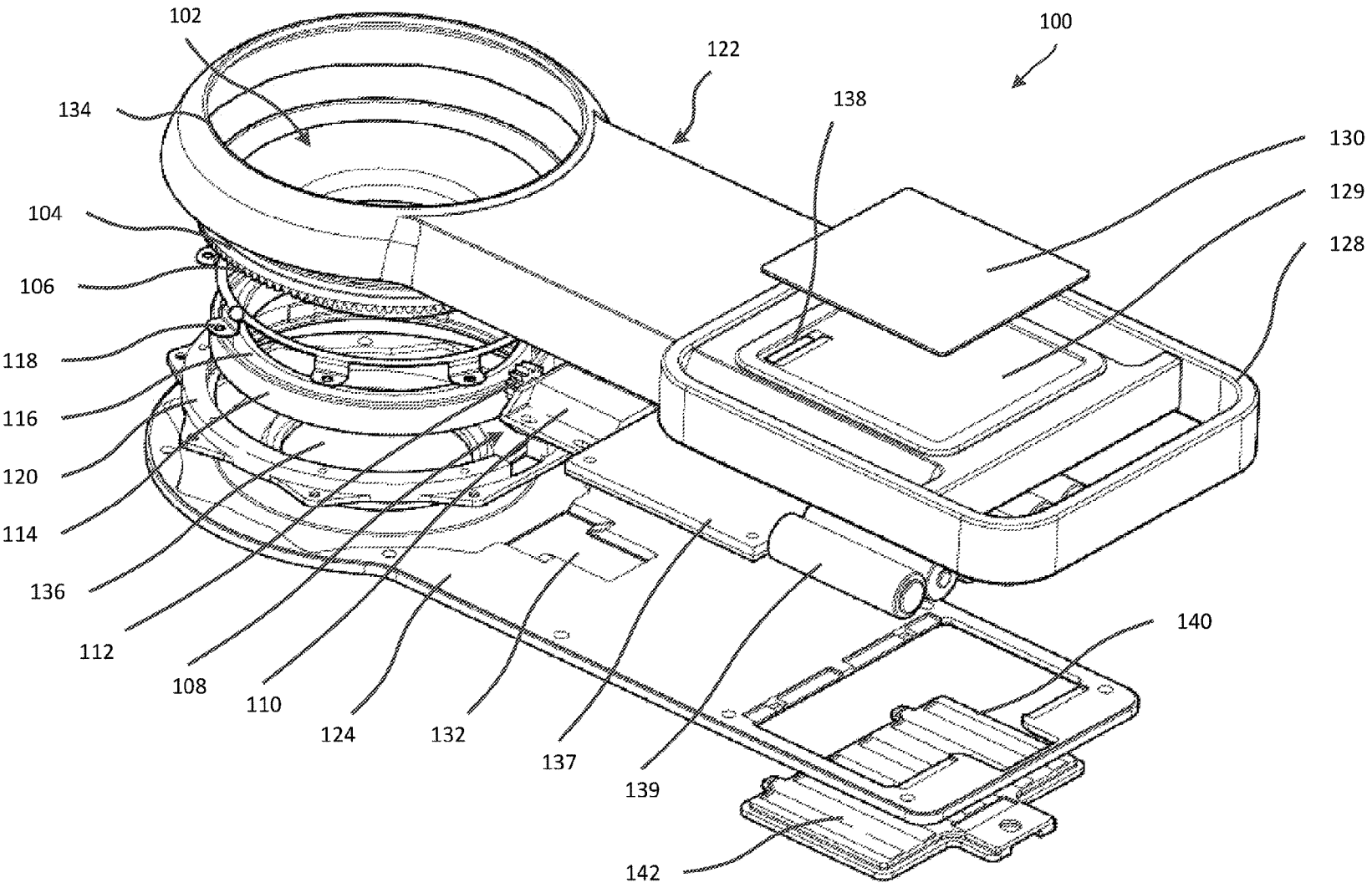
FIGS. 1 and 2 show exploded views of a sports apparatus viewed from above and below.
Figure 2:
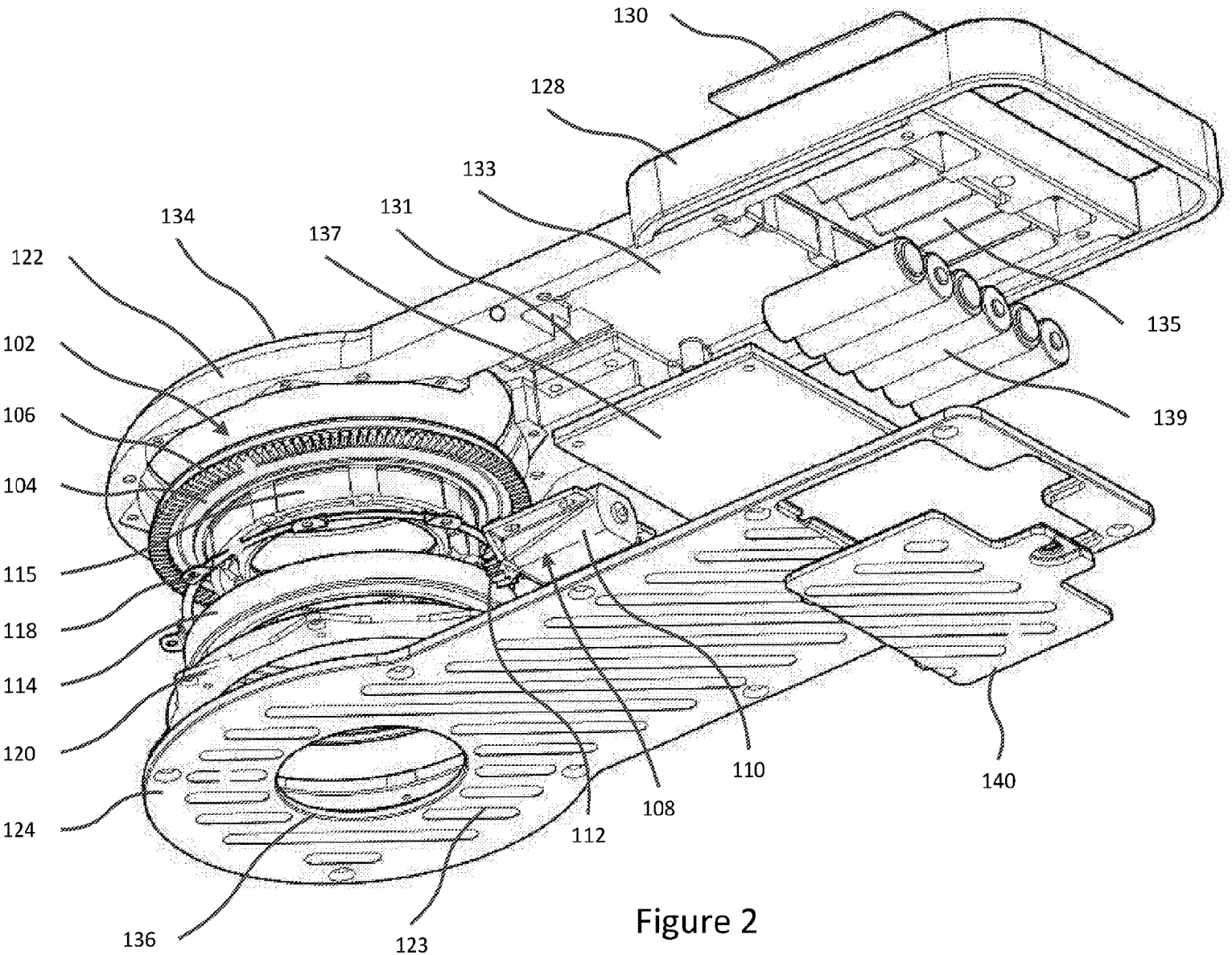

FIGS. 1 and 2 show a sports apparatus 100. These figures show exploded views of the apparatus 100 as viewed from above and below respectively.

The apparatus 100 has a ball holder 102 upon which a ball can be placed. A motor 110 is arranged to rotate the ball holder 102 and thereby rotate a ball which has been placed on the ball holder 102. The ball holder 102 is positioned suitably so that a user can strike the ball, which is being held and rotated by the ball holder 102, with their foot.

It has been recognised that the height of the ball holder 102 with respect to the ground beneath, or other supporting surface upon which the apparatus 100 is placed, should be minimised so that any motor skills and muscle memory developed by the user when training using the sports apparatus 100 can be easily transferred to the situation where a football is placed on the same level as the user is standing on, for example the surface of a football pitch. The total height of a ball, being held by the apparatus 100, with respect to the given supporting surface is preferably less than 25 millimetres.

The ball holder 102 comprises an annular ring 104 and an annular ring gear 106. The annular ring gear 106 is arranged on the underside of the annular ring 104. The apparatus 100 also includes a motor sub-assembly 108 which comprises the motor 110 and a pinion gear 112. The motor sub-assembly 108 is disposed adjacent the ball holder 102 such that the pinion gear 112 of the motor sub-assembly 108 is arranged to engage with the annular ring gear 106 of the ball holder 102 thereby to rotate the ball holder 102.

Whilst FIG. 1 shows the ball holder 102 being driven by the motor 110 via an annular ring gear 106 and pinion gear 112 arrangement, it should be understood that any gearing arrangement which permits the motor 110 to drive the ball holder 102 while the motor sub-assembly 108 is adjacent the ball holder 102 could be employed. Examples of such gearing arrangements include bevel gears, mitre gears or hypoid gears. A further example of a gearing arrangement that might be employed is the use of a worm gear instead of a pinion gear. In this case, the motor sub-assembly 108 would be rotated 90 degrees in the horizontal plane, so that the axis of rotation of the worm gear is tangential to the annular ring gear 106 of the ball holder 102.

Furthermore, whilst FIGS. 1 and 2 show the annular ring gear 106 arranged on the underside of the annular ring 104, such that the annular ring gear 106 and the pinion gear 112 rotate about perpendicular axes, the annular ring gear 106 of the ball holder 102 could be arranged around the circumference of the ball holder 102, with its teeth pointed radially outwards. In this case the pinion gear 112 would have its axis of rotation parallel to the axis of rotation of the ball holder 102 so that the two gears mesh.

Furthermore, whilst FIGS. 1 and 2 show the annular ring gear 106 being driven by a pinion gear 112, where the axes of rotation of the two gears intersect, the motor 110 could drive the ball holder 102 via a gearing arrangement where the driving gear (the pinion gear 112 in FIGS. 1 and 2) engages with the ball holder 102 at an oblique angle, such that the axes of rotation of the driving gear and the ball holder 102 do not intersect. In this case, the driving gear may have a spiral-tooth arrangement rather than a straight-tooth arrangement.

Furthermore, whilst FIGS. 1 and 2 show the ball holder 102 being driven by a gearing arrangement, the ball holder 102 may also be driven by means of a belt or chain assembly. In this embodiment, a belt or chain is coupled to both the motor 110 and the ball holder 102 so that when the belt or chain is driven by the motor 110, the belt or chain acts to rotate the ball holder 102.

The apparatus 100 also includes a bearing 114 which has an annular shape designed to coincide with the annular shape of the ball holder 102, so that the ball holder 102 can rotate on the annular bearing 114. The ball holder 102 has a skirt 115 from its underside and the annular bearing 114 has an annular groove 116 between its inner radius and its outer radius. The annular groove 116 is arranged to receive the skirt 115 of the ball holder 102 such that the skirt 115 of the ball holder 102 can rotate in the annular groove 116 of the annular bearing 114. It should be understood that alternative bearing arrangements are also possible. An example of an alternative bearing arrangement would be where the underside of the ball holder 102 has a flat face, rather than a skirt 115, and the annular bearing 114 is a ball bearing, wherein the annular groove 116 of the annular bearing 114 contains ball bearings, and whereby the balls provide a surface upon which the flat face of the ball holder 102 can rest and rotate. The annular bearing 114 can be clamped, using upper 118 and lower 120 portions of a clamping arrangement, to secure the bearing 114 to the base of the apparatus 100.

Figure 4:
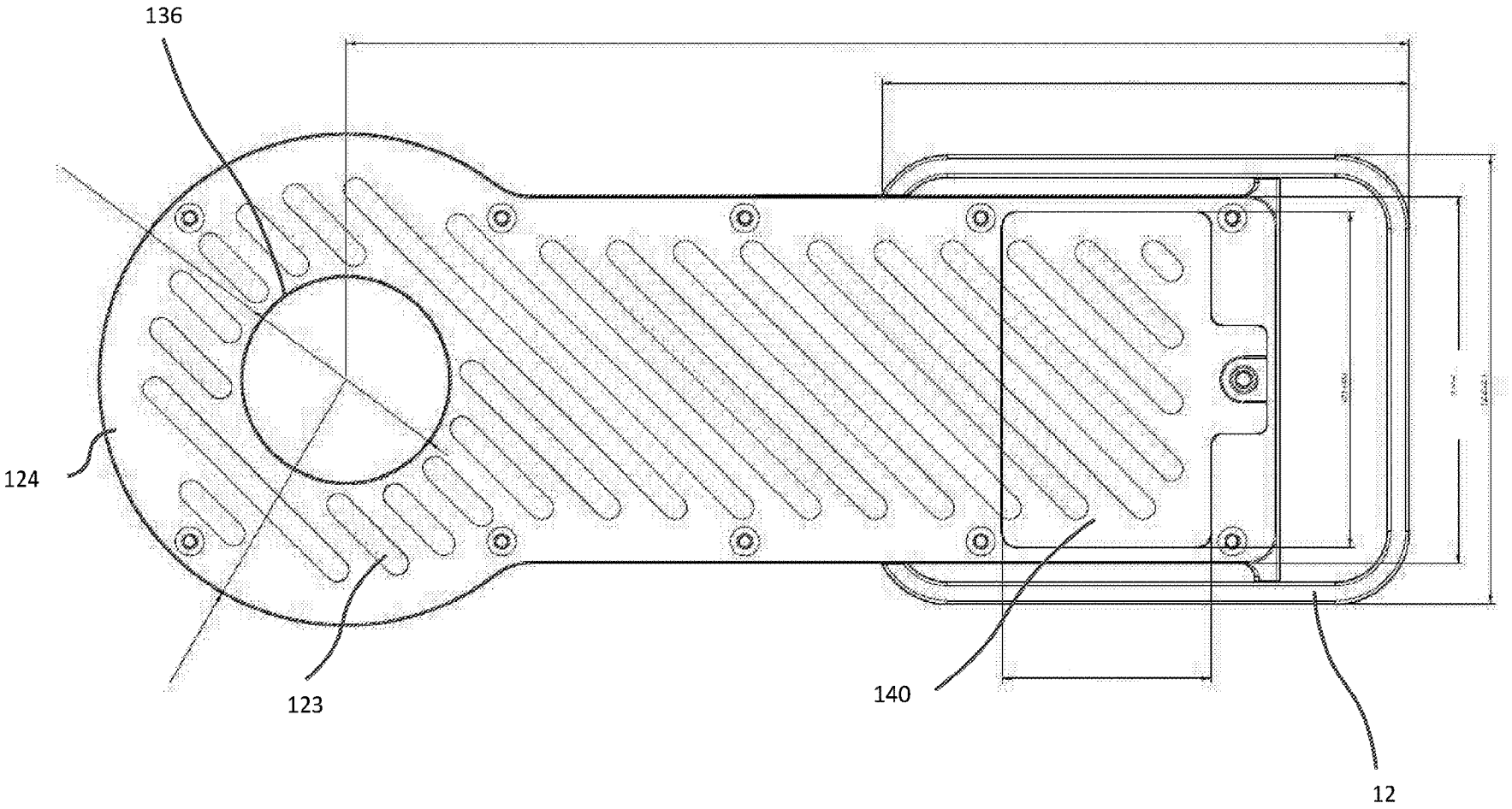
FIG. 4 shows the sports apparatus from below.

The apparatus 100 also includes a housing 122 and a base 124. The base 124 is arranged to contact a given supporting surface which could be, for example, the ground of a playing field, and as such has one or more grooves 123 on its underside which engage the supporting surface to provide grip. The underside of the apparatus 100 can be clearly seen in FIG. 4. It should be understood that any alternative arrangement which allows the underside of the base 124 to sufficiently engage the supporting surface, such that it grips the supporting surface, would be suitable. Examples of alternative gripping arrangements include feet or spikes on the underside of the base which are designed to engage the supporting surface. Alternatively, the base 124 could be provided with a number of holes, through which the device could be secured to the ground using pegs.

The housing 122 is arranged to retain the ball holder 102 and the bearing 114. The housing 122 has further features, such as a handle 128, a cut-out portion on its topside 129 to receive a control panel 130 and cut-out portions on its underside 131, 133 and 135 to accommodate the motor sub-assembly 108, a printed circuit board (PCB) 137 and the batteries 139 respectively. The base 124 has a cut-out portion 132 in which the motor sub-assembly 108 is located. The base 124 also has cut-out portions 135 in which the batteries 139 are located. These cut-out portions are positioned offset from one another in substantially the same plane to minimise the height of a ball, being held by the apparatus 100 above a given supporting surface. The base 124 also includes a removable and/or detachable portion which forms a cover 140 for the batteries 139 when they are located in the cut-out portions 135 of the housing 122. This battery cover 140 is detachable and resealable so that the batteries 139 can be removed, for example when they have exhausted their power, through the gap in the base 124 which appears once the battery cover 140 is detached. The battery cover 140 includes cut-out grooves 142 which can accommodate the batteries 139. These cut-out grooves 142 mean that the height of a ball, being held by the apparatus 100, is further minimised.

Figure 3:
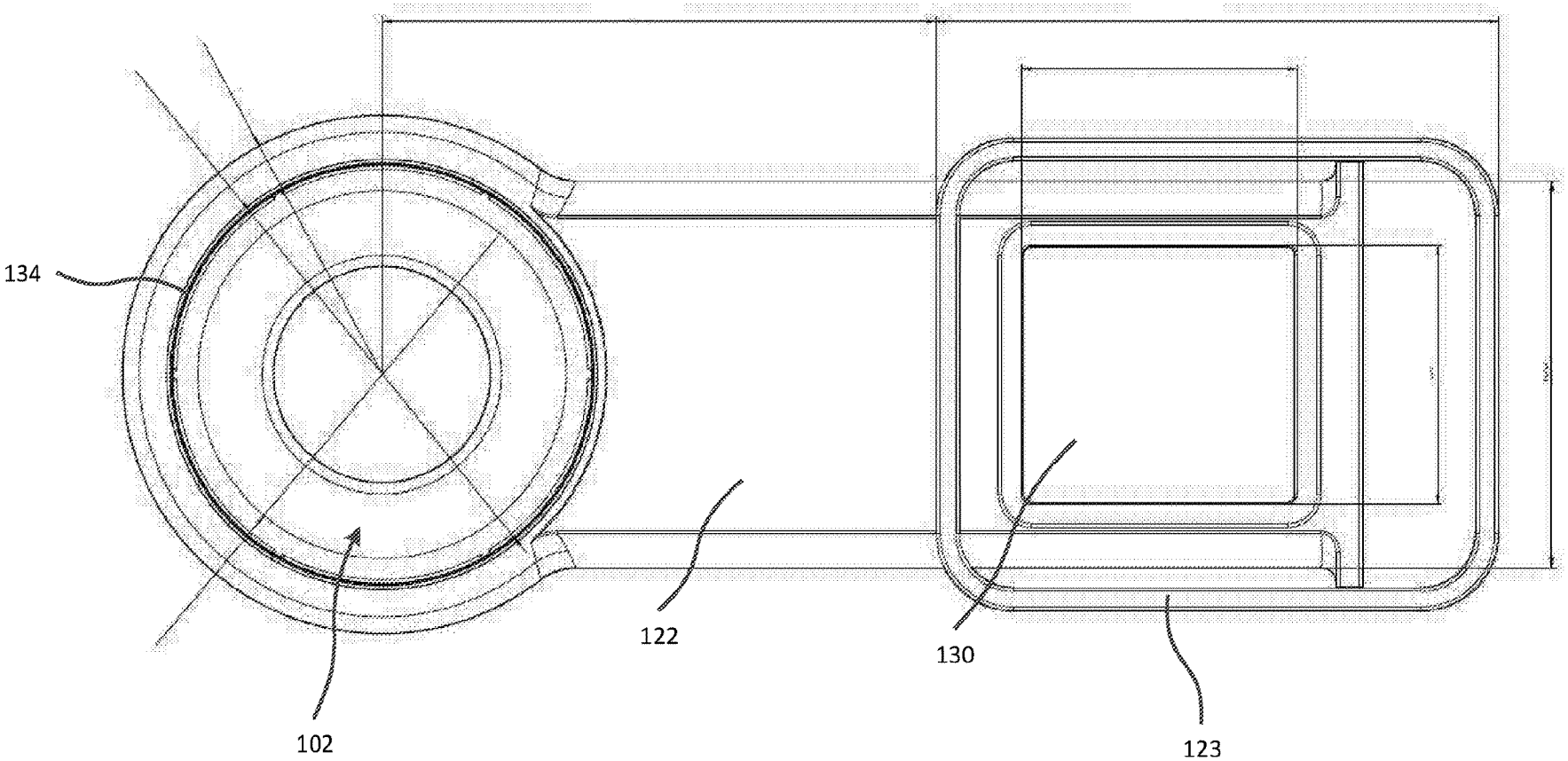
FIG. 3 shows the sports apparatus from above.

The housing 122 has a circular opening 134 at one end revealing the ball holder 102. The base 124, too, has a circular opening 136 at one end. The circular opening 134 in the housing 122, the ball holder 102, the annular bearing 114 and the opening 136 in the base 124 are all aligned along a common vertical axis as can be seen in FIG. 3. This arrangement defines a space through the centre of, and just beneath, the ball holder 102 such that, when a ball is held by the ball holder 102, the portion of the ball which extends below to horizontal plane defined by the circular opening 134 of the housing 122 can occupy this space, meaning that components, such as the bearing 114, do not need to be positioned below the lower-most point of the ball which is being held. This arrangement allows the height of a ball, being held by the apparatus 100, above the supporting surface, to be minimised.

The annular shape of the ball holder 102 also provides a more secure grip on a ball, located within the ball holder 102, than is provided by a bowl shaped ball holder. When spinning a ball in a bowl shaped ball holder, the ball might rotate up the side of the bowl, and may fall off of the apparatus 100. The annular ball holder 102 of the apparatus provides a more secure grip on the ball. Furthermore, should the ball become perturbed during rotation, for example in the case of a football which is not perfectly spherical so that it generates a wobble when rotating at high frequencies, the annular shaped ball holder 102 is advantageous over a bowl shaped ball holder as it is better shaped to act against such a wobble.

The PCB 137 receives power from the batteries 139, and inputs from the control panel 130, and outputs a signal to the motor 110 in order to rotate the ball holder 102 at a rate determined by the user's input to the control panel 130. The PCB 137 may receive inputs from the control panel 130 via a cable, such as a ribbon cable, which can be threaded through a hole in the housing 138. Alternatively, the PCB 137 could receive inputs from the control panel 130 remotely, for example via WiFi™, Bluetooth™ or Zigbee™. While power to the motor 110 is preferably supplied by batteries 139, in order to maximise the portability of the apparatus 100, it should be understood that other forms of power supply would be possible with this device. An example of an alternative form of power supply may be a wired connection to a mains power supply.

The control panel 130 and the PCB 137 together comprise a control system for the motor 110. The control system enables the motor 110 to be controlled so that a user can select the speed and direction of rotation of the ball holder 102. The control system allows the user to select which direction, i.e. clockwise or anti clockwise, the ball holder 102 should rotate. The control system allows the user to select the rate of rotation of the ball holder 102. The control system includes further features such as a soft start mechanism, which will gradually bring the motor 110 to the desired speed. This soft start mechanism may slowly ramp up the power sent to the motor 110, until it is driving the ball holder 102 at the desired rate, so that the ball which rests on the ball holder 102 receives a stable acceleration rather than a sudden acceleration which could destabilise the ball on the ball holder 102. It should be understood that the control system could be replaced by any alternative circuitry which would allow inputs from a user to be output to the motor 110 in order to rotate the ball holder 102 in accordance with user's inputs. An example of an alternative control system is a simple electronic circuit, whereby a user can directly vary the power supplied to the motor 110 rather than using a control panel and a PCB. The control system may also include means for measurement and/or feedback system, whereby the rotation rate of the ball holder 102 is measured and/or fed back to the control system thereby allowing the control system to adjust the output to the motor 110 based on the measurement. In this way, the rotation speed of the ball holder 102 can be made more consistent.

Preferably, the control system is arranged so that the user can control the apparatus to rotate the ball holder 102 at any number of revolutions per minute (RPM) within the range 0 to 600 RPM, such as 150 or 333 RPM. Alternatively, the control system may be arranged so that the user can select the rate of rotation of the ball holder 102 from discrete incremented values of RPM, such as 100 RPM, 200 RPM, 300 RPM and so on.

Figure 5:
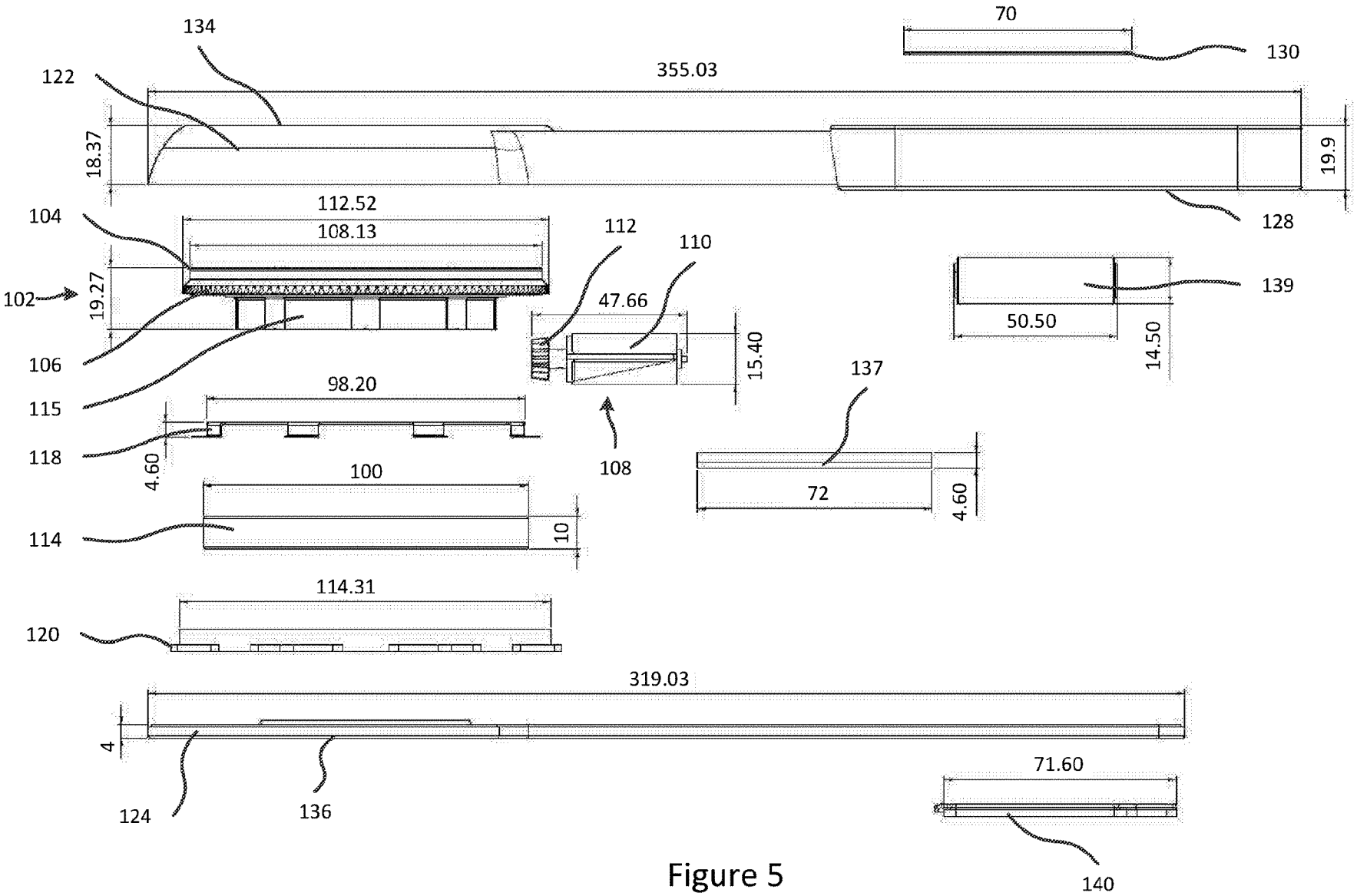
FIG. 5 shows an exploded side profile view of the sports apparatus.

FIG. 5 shows an exploded side profile view of the sports apparatus. The three components of the ball holder 102 can clearly be seen: the annular ring 104, the annular ring gear 106 and the skirt 115. The diameter of the annular ring gear 106 is slightly larger than the diameter of the annular ring 104 forming a chamfered rim around the ball holder 102. The circular portion of the housing 122 is also chamfered so that the housing 122 slopes from the circular opening 134 down to the base 124.

The diameter of the circular opening 134 is larger than the diameter of the annular ring 104 but smaller than the diameter of the annular ring gear 106. Therefore, when the housing 122 is attached to the base 124, the annular ring 104 will protrude through the circular opening 134 in the housing 122.

Furthermore, given that the skirt 115 of the ball holder 102 sits in the groove 116 of the bearing 114, the ball holder 102 is not necessarily secured to the apparatus by the bearing 114. Therefore, in order to ensure the ball holder 102 cannot escape the device while it is rotating, the diameter of the annular ring gear 106 is greater than the diameter of the circular opening 134. Furthermore, the shapes of the chamfered rim of the ball holder 102 and the inner side of the chamfered portion of the housing 122 are designed to complement one another so that they engage one another such that the inside surface of the chamfered circular portion of the housing 122 acts as a guard to retain the ball holder 102 in position.

Another reason for the shape of the chamfered circular portion of the housing 122 is so that the housing will advantageously direct the user's foot towards the ball in the situation where a user mistakenly strikes the housing 122 of the apparatus while attempting to strike the ball.

Figure 6:
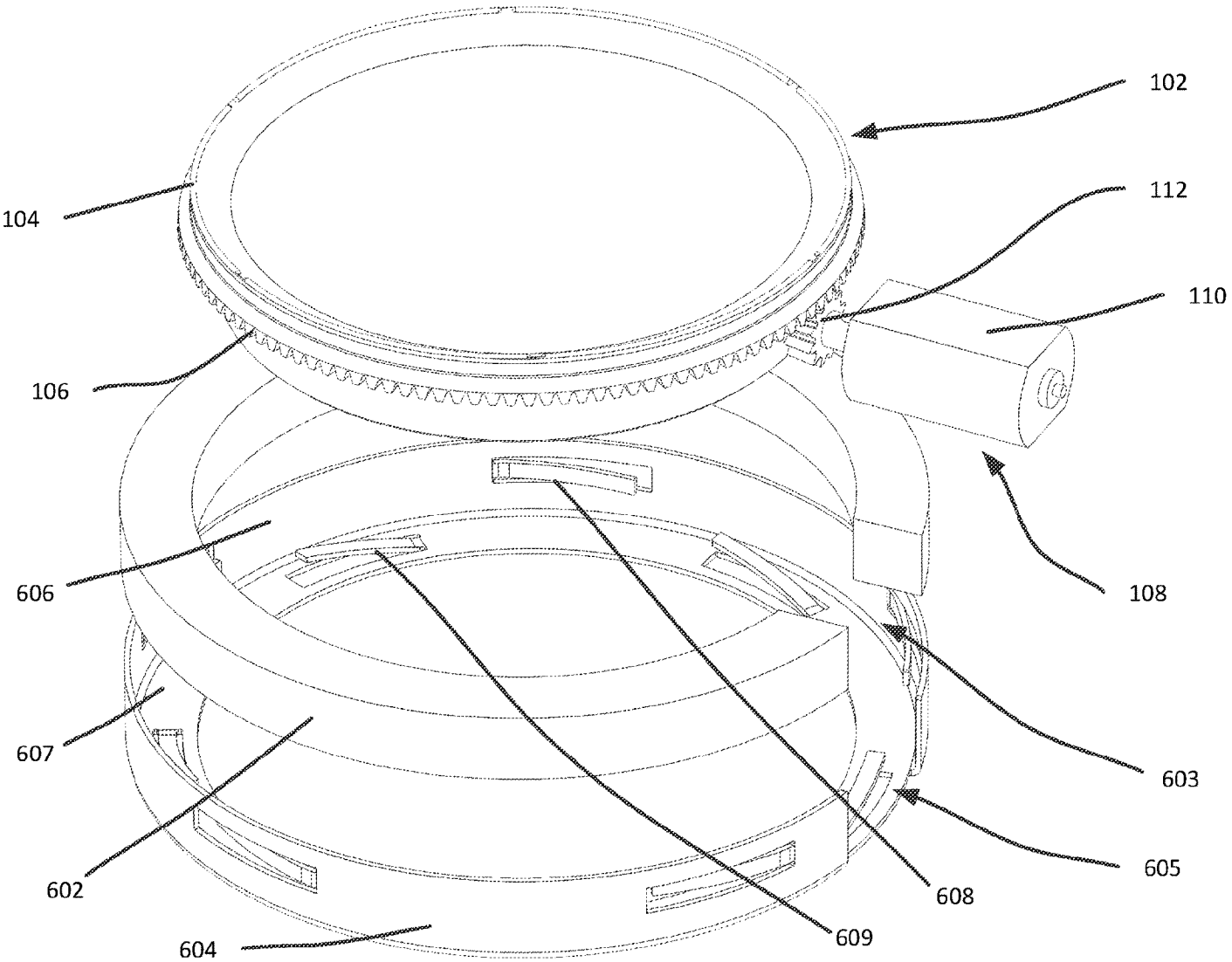
FIG. 6 shows an exploded view of an example damping mechanism for the sports apparatus.

FIG. 6 shows an exploded view of an example damping mechanism for the sports apparatus. In the embodiment of FIG. 6, the ball holder 102 is a cup shape, rather than an annular ring shape. The damping mechanism is provided to inhibit ball wobble or vibration which is generated when a non-spherical ball is rotated at a high frequency by the sports apparatus.

The ball holder 102 and the motor sub-assembly 108 are arranged to fit within a ball holder casing 602. The ball holder casing 602 has an annular shape with a cut-out portion 603 so as to accommodate the motor sub-assembly 108. The example damping mechanism also comprises a spring loaded casing 604. The spring loaded casing 604 has an annular shape with a cut-out portion 605 so as to accommodate the motor sub-assembly 108. The cut-out portions 603 and 605 both contribute to the aim of minimising the over height of a ball, being held by the apparatus 100, above the supporting surface.

The spring loaded casing 604 has a side wall 606 and a lower lip 607. A number of spring tabs 608 are provided on the side wall 606 in order to compensate for the lateral component of ball wobble. A number of spring tabs 609 are also provided on the lower lip 607 in order to compensate for the vertical component of ball wobble. The spring loaded casing 604 is arranged to retain the ball holder 102, the motor sub-assembly 108 and the ball holder casing 602 via a friction fit. Specifically, the ball holder casing 602 is supported and retained by the spring tabs 608 and 609 so as to dampen any ball wobble.

While the damping mechanism provides a means to inhibit ball wobble, it also provides a means to cushion the surrounding parts of the sports apparatus 100 from the impact of a user striking the ball from the ball holder 102. In the case where a user strikes the ball off centre, the impact might cause the ball to be driven downwards towards the sports apparatus 100. The spring tabs 608 and 609 would therefore act to cushion the sports apparatus 100 from that impact. Similarly, when striking a ball from the ball holder 102 the user might accidentally make contact with the ball holder 102 itself, thus causing the ball holder 102 to move suddenly. In this case the spring tabs 608 and 609 would act to dampen the motion of the ball holder 102 to minimise the force transmitted to the rest of the apparatus.

While FIG. 6 shows the damping mechanism comprising a side wall 606 and a lower lip 607, any configuration of springs and/or cushions which damp the motion of a wobbling ball held by the ball holder 102 would be suitable. For example, the spring loaded casing 604 could have only a side wall 606, including spring tabs 608 and, instead of having a lower lip 607, there could be further spring tabs attached to the bottom of the side wall 606 pointing radially inward thus taking the place of the lower lip 607 and the spring tabs 609.

Similarly, while FIG. 6 shows the use of spring tabs 608 and 609, these could be replaced by any other elastic mechanism. For example the spring tabs 608 and 609 could be replaced with an appropriate helical coil spring or, rather than using springs, the damping mechanism could use a rubber cushion. Similarly, while FIG. 6 shows the ball holder 102 and the ball holder casing 602 being supported by the spring tabs 609 from below, the ball holder 102 and/or ball holder casing 602 could be suspended by an elastic mechanism from above.

Various other modifications will be apparent to those skilled in the art. It will be understood that the present invention has been described above purely by way of example, and modifications of detail can be made within the scope of the invention.

Each feature disclosed in the description, and (where appropriate) the claims and drawings may be provided independently or in any appropriate combination.

Reference numerals appearing in the claims are by way of illustration only and shall have no limiting effect on the scope of the claims.

What is claimed is:

1. A sports apparatus comprising:

a ball holder; and a motor arranged to rotate said ball holder;

wherein an axis of rotation of a drive of the motor s perpendicular to the avis of rotation of the ball holder;

wherein the motor is arranged to drive rotation of the ball holder via a side engagement of the ball holder, and wherein the motor is arranged to drive rotation of the ball holder via a coupling, wherein the coupling is in the form of a gearing arrangement to drive rotation of the ball holder.

2. The apparatus of claim 1, wherein the apparatus is arranged to contact a given supporting surface to position the ball holder for a user to strike a ball being held and rotated by the ball holder.

3. The apparatus of claim 1, wherein the motor is laterally offset with respect to the ball holder.

4. The apparatus of claim 1, wherein the motor is disposed adjacent said ball holder.

5. The apparatus of claim 1. wherein the motor and the ball holder are arranged in the same plane.

6. The apparatus of claim 5, wherein that plane is parallel to a given supporting surface on which the apparatus is mounted.

7. The apparatus of claim 1, further comprising a control system for controlling the rotation of the ball holder; wherein the control system controls the rotation of the ball holder by regulating power supplied to the motor.

8. The apparatus of claim 7, wherein the control system is arranged in the same plane as the ball holder.

9. The apparatus of claim 1, further comprising a power supply for powering the motor, wherein the power supply is in the form of a battery, pack.

10. The apparatus of claim 9, wherein the power supply is arranged in the same plane as the ball holder, wherein that plane is parallel to a given supporting surface on which the apparatus is mounted.

11. The apparatus of claim 1, wherein the ball holder is arranged to rotate on a bearing, wherein the bearing comprises an annular groove arranged to receive a skirt of the ball holder such that the skirt of the ball holder can rotate within the annular grove of the annular bearing.

12. The apparatus of claim 1, wherein the ball holder comprises an annular ring arranged on an underside of the annular ring.

13. The apparatus of claim 1, further comprising a housing and a base, wherein the housing and base are arranged to retain the ball holder wherein the housing has an opening arranged to expose the ball holder, such that a ball can be held on the ball holder through said opening.

14. A sports apparatus comprising:

a ball holder; and a motor arranged to rotate said ball holder;

wherein an axis of rotation of a drive of the motor is perpendicular to the axis of rotation of the ball holder;

wherein the motor is arranged to drive rotation of the ball holder via a side engagement of the ball holder; and wherein the total height of the apparatus is less than 50 millimetres.

15. The apparatus of claim 1, wherein the clearance between a ball, being held and rotated by the ball holder of the apparatus, and a given supporting surface on which the ball holder is mounted is less than 10 millimetres.

16. The apparatus of claim 1, further comprising one or more sensors, wherein said one or more sensors are arranged to identify one or more characteristics of the motion of the ball which has been struck from the apparatus by a user, wherein:

a. the one or more sensors are at least one of: pressure sensors; force sensors; optical sensors; acoustic sensors; or motion sensors; and/or b. the one or more characteristics of the motion of the ball are at least one of: the speed; the direction of motion; the time of flight; the distance travelled; the height as a function of flight time or distance; the direction of motion as a function of flight time or distance; or a measure of curling of the ball; and/or c. the one or more sensors are directly attached to, or attached within, the apparatus; or d. the one or more sensors are located remotely from the apparatus.

17. A sports apparatus comprising:

a ball holder:

a motor arranged to rotate said ball holder; and a damping mechanism to dampen wobbling of a ball being held and rotated by the ball holder, wherein an axis of rotation of a drive of the motor is perpendicular to the axis of rotation of the ball holder and wherein the motor is arranged to drive rotation of the ball holder via a side engagement of the ball holder.

18. The apparatus of claim 17, wherein the damping mechanism comprises one or more springs arranged to dampen the vertical component of ball wobble during rotation.

* * * * *